United States Patent [19]

Fitzner

[11] 4,433,668

[45] Feb. 28, 1984

[54] CAPACITOR DISCHARGE IGNITION SYSTEM HAVING A CHARGING CONTROL MEANS

[75] Inventor: Arthur O. Fitzner, Fond du Lac, Wis.

[73] Assignee: Brunswick Corporation, Skokie, Ill.

[21] Appl. No.: 330,419

[22] Filed: Dec. 14, 1981

[51] Int. Cl.[3] ..... F02P 3/06; F02P 11/06

[52] U.S. Cl. ..... 123/597; 123/630

[58] Field of Search ..... 123/198 D, 596, 597, 123/599, 604, 605, 630; 324/380, 381, 382, 389; 340/52 R

[56] References Cited

U.S. PATENT DOCUMENTS

| | | | |
|---|---|---|---|
| 3,394,689 | 7/1968 | Bell | 123/656 X |
| 4,103,659 | 8/1978 | Donigian | 123/656 X |
| 4,115,758 | 9/1978 | Luteran | 123/630 X |

*Primary Examiner*—Tony M. Argenbright
*Attorney, Agent, or Firm*—O. T. Sessions

[57] ABSTRACT

The invention provides charging control circuitry (20) for a capacitor discharge ignition system (10) having power capacitors (21) connected to be discharged by main electronic switches such as SCR's (23) into ignition transformers (24) to sequentially fire the engine's spark plugs (16). The charging control circuits (20) each include a charging SCR (26) to limit charging current flow to the main capacitor (21), unless a discharge pulse into the ignition transformer (24) has occurred in the recent past. Thus if a short circuit in either the main capacitor (21) or main SCR (23) in one of the ignition circuits (19) prevents that ignition circuit from properly functioning, the charging SCR (26) will limit the flow of charging current to the defective circuit and allow the other ignition circuit (19) to receive charging current. The gate of the charging SCR (26) is controlled by an amplified signal from a memory capacitor (28) which is charged by the discharge pulse from the corresponding ignition circuit (19). The same memory capacitor (28) also provides power to drive an indicator such as a light emitting diode (40).

9 Claims, 1 Drawing Figure

CAPACITOR DISCHARGE IGNITION SYSTEM HAVING A CHARGING CONTROL MEANS

DESCRIPTION

TECHNICAL FIELD

This invention relates to a capacitor discharge ignition system for internal combustion engines and more particularly to the charging circuits thereof.

BACKGROUND ART

A number of electronic ignition systems have been developed to provide spark ignition for multi-cylinder internal combustion engines. Among them capacitor discharge systems, in which a capacitor or group of capacitors, is charged to a relatively high voltage and then rapidly discharged by controlled rectifiers through ignition transformers to fire the spark plugs of the various cylinders, have proven highly satisfactory. In many such systems it is desirable, for reasons of cost and size, to provide a single power source, such as a set of alternator stator windings, to charge the capacitor or capacitors. In such an arrangement, however, should one of the highly stressed controlled rectifiers or one of the capacitors for one cylinder short circuit, the entire system will generally cease functioning, since the shorted circuit element will usually draw substantially the full output of the power supply.

DISCLOSURE OF THE INVENTION

In accordance with the present invention a capacitor discharge ignition system for an internal combustion engine has an energy source and a power capacitor connected to be charged by the energy source. A main electronic switch is connected to discharge the power capacitor to fire a spark plug of the engine. A charging control means connected in circuit with the energy source, the power capacitor, and the main electronic switch limits the current flow from the energy source to the power capacitor in the event of failure of either the power capacitor or the electronic switch. This configuration allows a multi-cylinder engine to continue functioning should the power capacitor or electronic switch for one cylinder fail.

The charging control means may be turned fully on by a short term memory means which may be an energy storage means, such as a capacitor, connected to the discharge side of the electronic switch to be charged by the discharge pulse from the power capacitor. Failure of the circuit to produce a discharge pulse would thus fail to charge the energy storage means, which in turn would leave the charging control means only partially turned on.

The charging control means may readily include a charging electronic switch connected in series with the power capacitor and energy source and connected to be turned on by power from the energy storage means. Thus failure of the discharge circuit to produce a discharge pulse charging the energy storage means will result in turning off the charging control switch.

To allow starting of the engine a resistor is connected in parallel with the charging electronic switch to allow the power capacitor to be partially charged by current flowing through the resistor. With an appropriately sized resistor the power capacitor will be charged to a level sufficient to produce a small discharge pulse which is nevertheless adequate to charge the energy storage means and thus turn on the charging electronic switch.

An indicator light, such as a light emitting diode, may be provided and powered by the energy storage means. The light would not operate unless the ignition circuit was operating. On a multicylinder engine, this would provide a clear indication of the failure of the ignition system for one cylinder. The light could readily be provided without the charging control system for use with a separate power source for each cyclinder.

The ignition system may be manufactured with a separate ignition module for each cylinder. If one of the modules fails, the engine would continue to run on the remaining cylinders. The system can easily be diagnosed. With the indicator light showing which module was malfunctioning, the failed module could then readily be replaced.

BEST MODE FOR CARRYING OUT THE INVENTION

Figure 1:
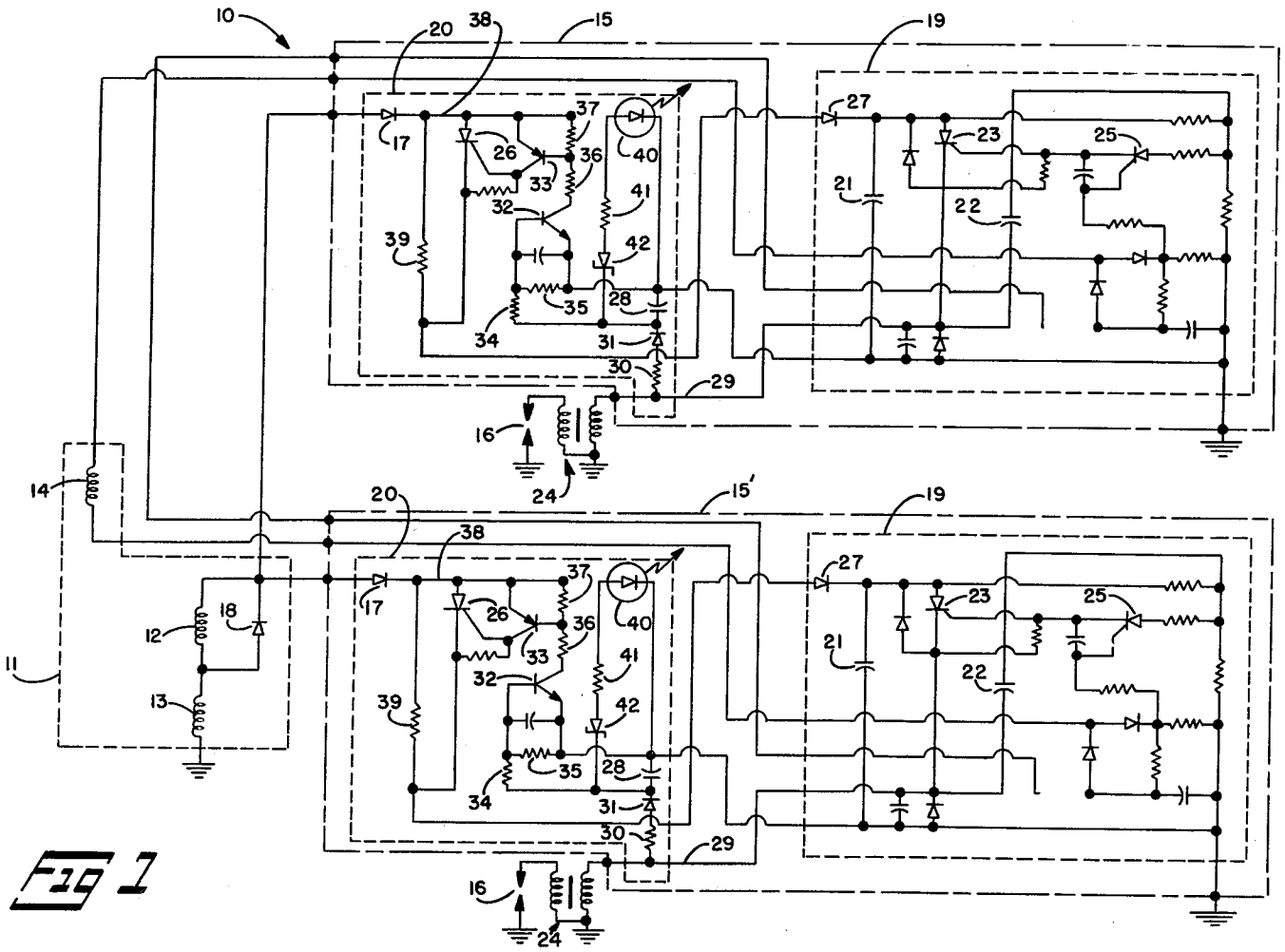
FIG. 1 is a schematic diagram of the ignition system of the invention applied to a two cylinder engine.

Referring to FIG. 1, an ignition system 10 for a two cylinder internal combustion engine is shown. The ignition system 10 includes a flywheel driven alternator 11 having low and high speed charging windings 12 and 13 and a trigger winding 14, excited by magnets mounted on the engine flywheel, not illustrated. Two identical ignition modules 15 and 15' are connected to be powered by the low and high speed windings 12 and 13 are triggered by the trigger winding 14 to fire the two engine spark plugs 16.

The alternator's low speed winding 12 and high speed winding 13 are connected through diodes 17 to supply current of a single polarity to the ignition modules 15 and 15'. The low speed winding 12 has a large number of turns of very fine wire to assure an output during starting and idle while the high speed winding 13 has a much smaller number of turns normally of heavier wire. A diode 18, connected across the low speed winding 12, assures a current path for the low speed winding 12 when the voltage induced in the winding 12 is of the polarity blocked by diodes 17.

Each of the ignition modules 15 and 15' includes an ignition circuit 19 and a charging circuit 20. The alternator windings 12 and 13 are connected to the two ignition circuits 19 through the two charging control circuits 20 to charge the main capacitors 21, and pilot power supply capacitors 22 in the ignition circuits 19. In each of the ignition circuits 19 a main gated switch 23, preferably a silicon controlled rectifier (SCR), is connected between the main capacitor 21 and an ignition transformer 24 to discharge the main capacitor 21 through the ignition transformer 24 and fire the spark plug 16. The main SCR 23 is triggered indirectly by a timed positive polarity trigger pulse generated in the trigger winding 14. The trigger winding 14 is connected through a triggering circuit to trigger a pilot SCR 25 which in turn discharges the pilot power supply capacitor 22 to the gate of the main SCR 23 to fire the main SCR 23. The ignition circuit is essentially the same as that described in applicant's copending U.S. patent application entitled "Capacitor Discharge Ignition System for Internal Combustion Engines", filed on the same date as this application, and is only described here to the extent required for understanding the present invention.

The charging control circuit 20 includes an SCR 26 having its anode connected through a diode 17 to the chargin windings 12 and 13 and its cathode connected through a diode 27 to the main capacitor 21 in the ignition circuit 19 to control the charging of the main capacitor 21. A memory capacitor 28, connected between the output line 29 of the ignition circuit and ground, is charged through a resistor 30 and diode 31 by the output discharge pulse to provide power to indirectly control the gate of the charging SCR 26. The diode 31 prevents discharge of the memory capacitor 28 through the output line 29 in the absence of the discharge pulse, while the resistor 30 limits the charging current to the memory capacitor 28 to the desired level. The memory capacitor 28 is sized and charged to provide a temporary memory signal indicating the presence of a discharge pulse in the recent past.

The memory capacitor 28 is connected to the gate of the charging SCR through a pair of direct coupled transistors 32 and 33 to provide gate current to the charging SCR when the memory capacitor is charged and when charging voltage appears across the charging control circuit. The first stage transistor 32 is shown as a NPN type transistor having base current supplied from the memory capacitor 28 through a voltage divider network formed by resistors 34 and 35. Its emitter is connected directly to ground and its collector is connected to the stator input line 38 through resistors 36 and 37. The second stage transistor 33, shown as a PNP type, has its base connected to the node between resistors 36 and 37, its emitter tied to the stator input line 38, and its collector connected to the gate of the charging SCR 26. Thus the second stage transistor 33 provides an amplified signal to the gate of the charging SCR 26 only when the firt stage transistor 32 is biased to conduct by the memory capacitor 28.

A bypass resistor 39 is provided in parallel with the charging SCR 26 to allow a limited current to flow through the charging circuit when the charging SCR 26 is in its nonconducting state. Thus the memory capacitor 28 may be charged during engine starting since the limited bypass current will provide a limited charge to the main ignition capacitor 21 and provide a small output discharge pulse.

A light emitting diode 40 in series with the resistor 41 is connected across the memory capacitor 28 to provide a visual indicator when the memory capacitor 28 is charged. A zener diode 42 connected in series with the light emitting diode 40 and resistor 41 prevents the light emitting diode 40 from drawing down the charge of the memory capacitor 28 below that needed to activate the charging SCR 26.

In normal operation, as the engine is being started, the charging SCR 26 is turned off because the memory capacitor 28 has not been charged. The first charging pulse from the alternator's charging windings 12 and 13 will, therefor, pass through the charging diodes 17 to the bypass resistors 39 and on to the ignition circuits 19 to provide a limited charge to the main ignition capacitors 21. The next trigger pulse from the trigger winding 14 to one of the ignition circuits 19 will then discharge the main ignition capacitor 21 through the main SCR 23 and into the primary coil of the ignition transformer 24. Though the discharge pulse may not be strong enough to fire the spark plug 16, enough voltage is produced in the output line 29 to provide a low level of charge to the memory capacitor 28 through the resistor 30 and diode 31. Though the level of charge may be too low to provide current through the zener diode 42 to the light emitting diode 40, the memory capacitor 28 will still provide a current through the voltage divider resistors 34 and 35 and to the base of the first stage transistor 32 to allow current to flow through the transistor. On the next charging pulse, part of the charging current will flow through the resistors 36 and 37 through the first stage transistor 32 to ground. This will provide current to the base of the second stage transistor 33 to turn it on and allow a portion of the charging current to flow through the second stage transistor 33 to the gate of the charging SCR 26 to turn it on. The greater part of the charging current then flows through the charging SCR 26 to provide a full charge to the main ignition capacitor 21.

Followig the next trigger pulse to that ignition module the main capacitor 21 will discharge again, this time providing a full charge to the memory capacitor 28. The full charge will then provide current through the zener diode 42 to light the light emitting diode 40 as well as turn on the charging SCR 26, and succeeding pulses will continue to recharge the memory capacitor 28 to keep the system operating.

Now should one of the ignition circuits fail, for example by a short circuit through either the main SCR 23 or main capacitor 22, the charging pulse directed to that ignition circuit will be discharged to ground. As a result, no output pulse will be produced and the memory capacitor 28 in that charging module 15 will not be charged and very soon thereafter no current will be supplied to the gate of the charging SCR 26 in that module. The charging current to the failed ignition circuit is then limited to that which can flow through the bypass resistor 39. The remaining charging current can then be supplied to the other normally operating module and the engine can continue to function, though without the operation of one cylinder. Without the charging control circuits 20, the full output of the charging alternator 11 would have been drawn by the failed ignition circuit, preventing charging of the good ignition circuit as well. Thus the present invention allows the engine to continue to function in the presence of a failure in one of the ignition circuits.

Though the present invention has been illustrated for an engine having two cylinders and a corresponding two ignition modules, the modules can be used with engines having one, two, three, or more cylinders as disclosed in the inventor's copending application filed on the same date as this application.

I claim:

1. A capacitor discharge ignition system for an internal combustion engine, comprising:

(A) an energy source;

(B) a power capacitor connected to be charged by said energy source;

(C) a main electronic switch connected to discharge said power capacitor and fire a spark plug of said engine; and (D) a charging control means connected in circuit with said energy source, said power capacitor, and said main electronic switch to limit current flow from said energy source to said power capacitor should said power capacitor or said main electronic switch fail.

2. The ignition system defined in claim 1 wherein said charging control means includes an energy storage means connected to the discharge side of said electronic switch to be charged by the discharge pulse from said power capacitor.

3. The ignition system defined in claim 2 wherein said charging control means further comprises a charging electronic switch connected in series with said power capacitor and said energy source and connected to be turned on by power from said energy storage means.

4. The ignition system defined in claim 3 wherein said charging control means further comprises a resistor connected in parallel with said electronic switch to allow a limited current to charge said main capacitor when said electronic switch is turned off.

5. The ignition system defined in claim 4 wherein said charging control means further comprises an amplifier connected between said energy storage means and said electronic switch to provide an amplified signal to turn on said electronic switch.

6. The ignition system defined in claim 3 wherein said electronic switch is connected to said energy storage means to be turned on when said energy storage means is charged above a predetermined first level.

7. The ignition system defined in claim 6 further comprising an indicator light connected to said energy storage means to be turned on when said energy storage means is charged above a predetermined second level.

8. The ignition system defined in claim 1 further comprising an indicator light means connected to the discharge side of said main electronic switch to indicate the discharge of said power capacitor.

9. A capacitor discharge ignition system for a multicylinder internal combustion engine, comprising;

(A) an energy source;

(B) a plurality of power capacitors each connected to be charged by said energy source;

(C) a plurality of electronic switches, each connected to discharge a corresponding one of said power capacitors to fire one of the engine spark plugs; and (D) a plurality of charging control means each connected in circuit with said energy source and a corresponding one of said capacitors to limit current flow from said energy source to the corresponding one of said capacitors should said corresponding power capacitor or electronic switch fail.

* * * * *